US006497374B1

(12) United States Patent
Wu et al.

(10) Patent No.: US 6,497,374 B1
(45) Date of Patent: Dec. 24, 2002

(54) SINGLE-FUNCTIONAL SHOWER HEAD ASSEMBLY

(76) Inventors: Chin Lung Wu, No. 1, Alley 16, Lane 40, Jinn Te Rd., Taichung (TW); Ling Jyi Yang, No. 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 09/905,825

(22) Filed: Jul. 16, 2001

(51) Int. Cl.[7] ..... B05B 15/08

(52) U.S. Cl. ..... 239/587.4; 239/587.1; 239/552; 239/600; 239/DIG. 4

(58) Field of Search ..... 239/548, 552, 239/504, 567, 587.1, 587.3, 587.4, 600, DIG. 4

(56) References Cited

U.S. PATENT DOCUMENTS 3,887,136 A * 6/1975 Anderson ..... 239/587.4
4,272,022 A * 6/1981 Evans ..... 239/600
4,275,843 A * 6/1981 Moen ..... 239/587.4
4,561,593 A * 12/1985 Cammack et al. ..... 239/600
6,076,747 A * 6/2000 Ming-Yuan ..... 239/587.4

* cited by examiner

*Primary Examiner*—Steven J. Ganey

(57) ABSTRACT

A single-functional shower head assembly includes a universal connector having a ball inserted into the top end of a shower head housing, and a fit ring having a slight elasticity fitted on the ball of the universal connector in a forcibly fit manner from the other end of the shower head housing, so that the universal connector is positioned in the shower head housing, and the other parts may then be assembled into the shower head housing, thereby decreasing cost of production and enhancing productivity. In addition, the quality of products can be enhanced.

9 Claims, 4 Drawing Sheets

SINGLE-FUNCTIONAL SHOWER HEAD ASSEMBLY

BACKGROUND OF THE INVENTION

1. Field of the Invention

The present invention relates to a single-functional shower head assembly, and more particularly to a single-functional shower head assembly, the quality of products can be enhanced.

2. Description of the Related Art

A conventional single-functional shower head in accordance with the prior art shown in FIGS. 1 and 2 comprises a universal connector 1*a* serially mounted with a shower head housing 2*a*, a sealing ring 3*a*, a connecting member 4*a*, and a water outlet panel 6*a*. The connecting member is provided with heat melted wires 5*a*, so that the shower head housing 2*a* is combined with the connecting member 4*a* in a heat melted manner.

However, the conventional single-functional shower head has the following disadvantages.

1. The universal connector la made of metal has a greater volume and a heavier weight, thereby increasing cost of material and fabrication.

2. The connecting member 4*a* is provided with heat melted wires 5*a*, so that the shower head housing 2*a* is combined with the connecting member 4*a* in a heat melted manner. However, the heat melted process needs a higher cost. In addition, the two combining parts have to stably contact during the heat melted process for obtaining a better effect. However, the connecting member 4*a* has to force the sealing ring 3*a* to urge the universal connector 1*a* as shown in FIG. 2. The sealing ring 3*a* made of plastic material has a determined volume and elasticity, whereby the heat melted process is easily affected by the sealing ring 3*a*, so that the combination process is unstable, thereby decreasing the heat melted effect, and so that the sealing ring 3*a* cannot closely abut the ball of the universal connector, thereby greatly influencing the sealing effect. Thus, the defective products easily produce during fabrication.

3. The sealing ring 3*a* is subjected to the high temperature of the heat melted process, thereby decreasing the lifetime of the sealing ring 3*a* and the shower head. In addition, maintenance and replacement are difficult when the sealing ring 3*a* is worn out, so that it is necessary to replace a new shower head.

SUMMARY OF THE INVENTION

The present invention has arisen to mitigate and/or obviate the disadvantage of the conventional single-functional shower head assembly.

The primary objective of the present invention is to provide a single-functional shower head assembly including a universal connector having a ball inserted into the top end of a shower head housing, and a fit ring having a slight elasticity fitted on the ball of the universal connector in a forcibly fit manner from the other end of the shower head housing, so that the universal connector is positioned in the shower head housing, and the other parts may then be assembled into the shower head housing, thereby decreasing cost of production and enhancing productivity.

Another objective of the present invention is to provide a single-functional shower head assembly, wherein the quality of products can be enhanced.

In accordance with the present invention, there is provided a single-functional shower head assembly, comprising:

a hollow universal connector having a first end formed with a water inlet and a second end formed with a ball;

a shower head housing having a first end formed with a water outlet and a second end formed with a first seat defining a hole, a second seat formed in the shower head housing and located beside the first seat;

a fit ring having a slight elasticity fitted on the ball of the universal connector in a forcibly fit manner, the fit ring being inserted into the first seat of the shower head housing by pressing of the ball of the universal connector;

a substantially cylindrical urging member mounted in the second seat of the shower head housing and having an end face recessed with a ring;

a buffer pad mounted in the second seat of the shower head housing and having a first end formed with a first flange fitted into the ring of the urging member and a second end formed with a second flange; and a water outlet panel secured on the first end of the shower head housing and including a circular plate secured in the water outlet, and an annular wall mounted on the circular plate and rested on the second flange of the buffer pad.

Further benefits and advantages of the present invention will become apparent after a careful reading of the detailed description with appropriate reference to the accompanying drawings.

DETAILED DESCRIPTION OF THE INVENTION

Figure 1:
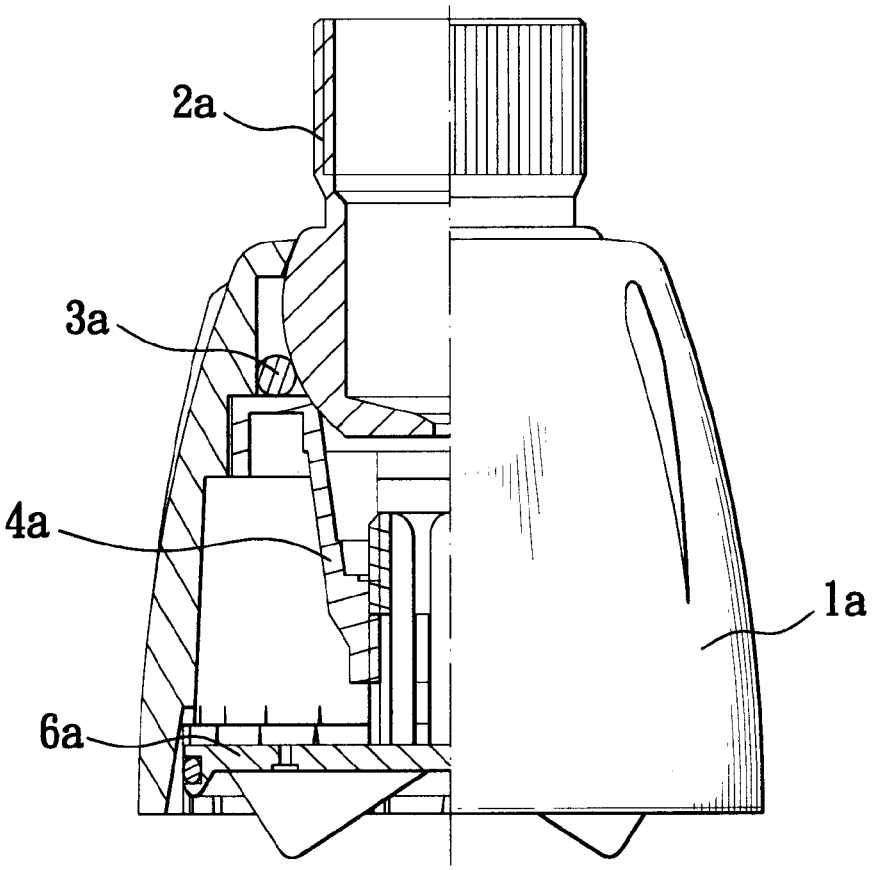
F I G. 1 PRIOR ART
FIG. 1 is a front plan cross-sectional assembly view of a conventional single-functional shower head in accordance with the prior art.
Figure 2:
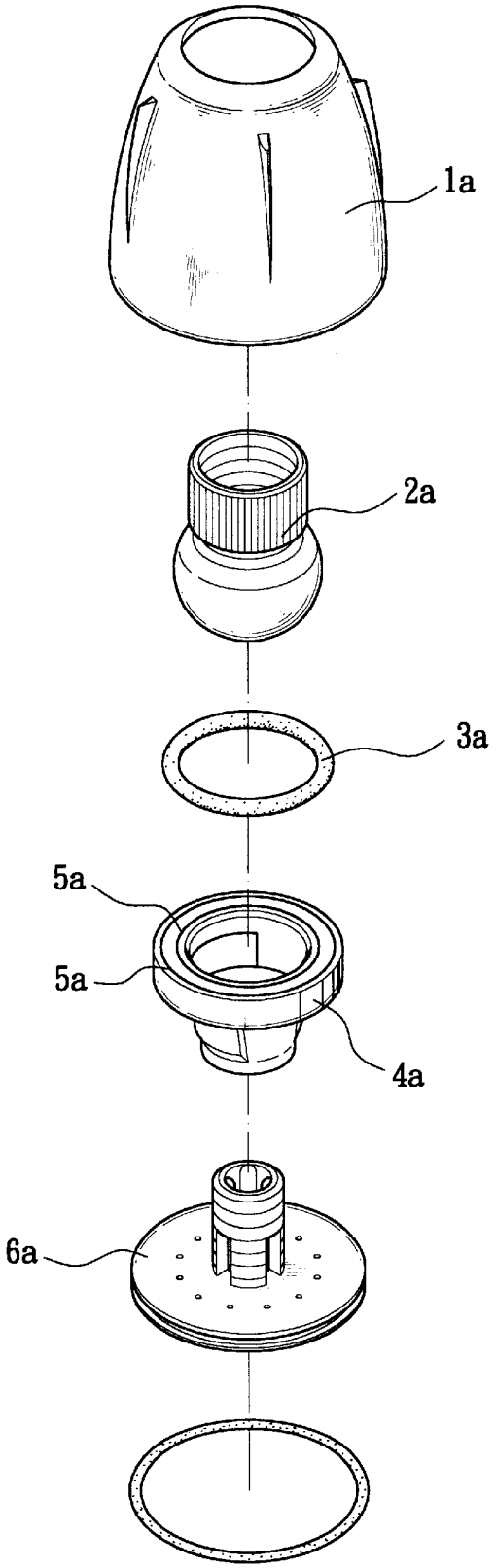
F I G. 2 PRIOR ART
FIG. 2 is an exploded perspective view of the conventional single-functional shower head as shown in FIG. 1.
Figure 3:
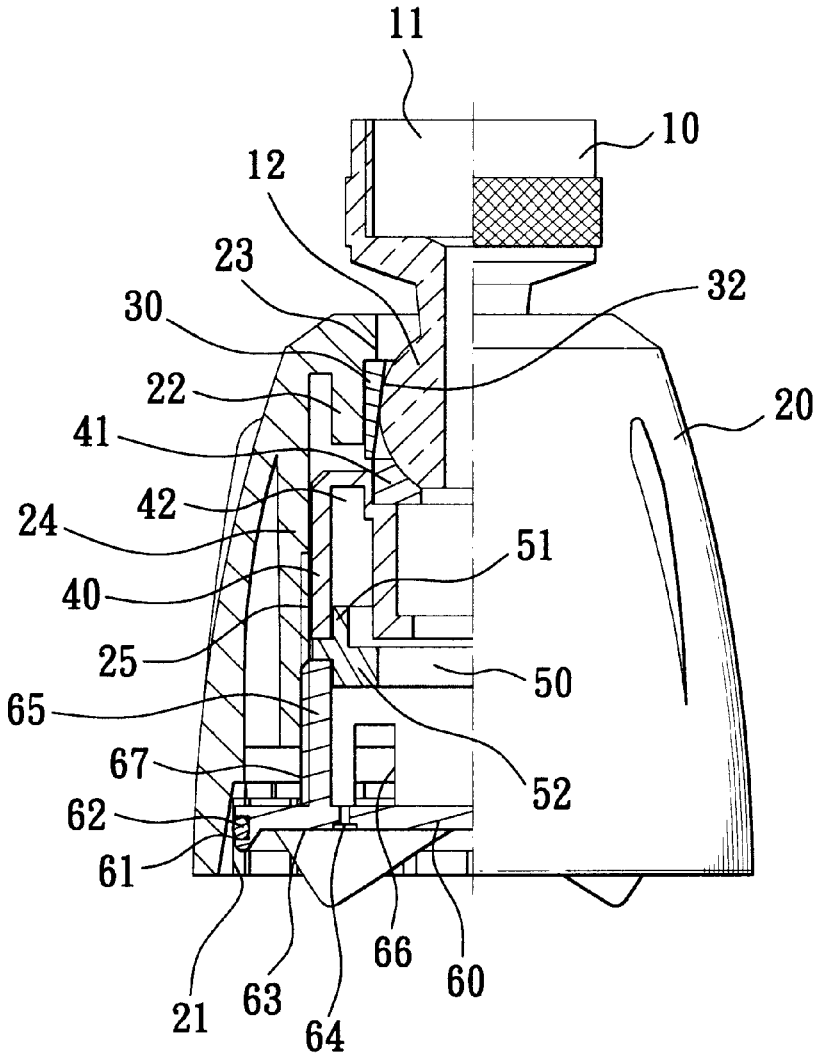
FIG. 3 is a front plan cross-sectional assembly view of a single-functional shower head assembly in accordance with the present invention.
Figure 4:
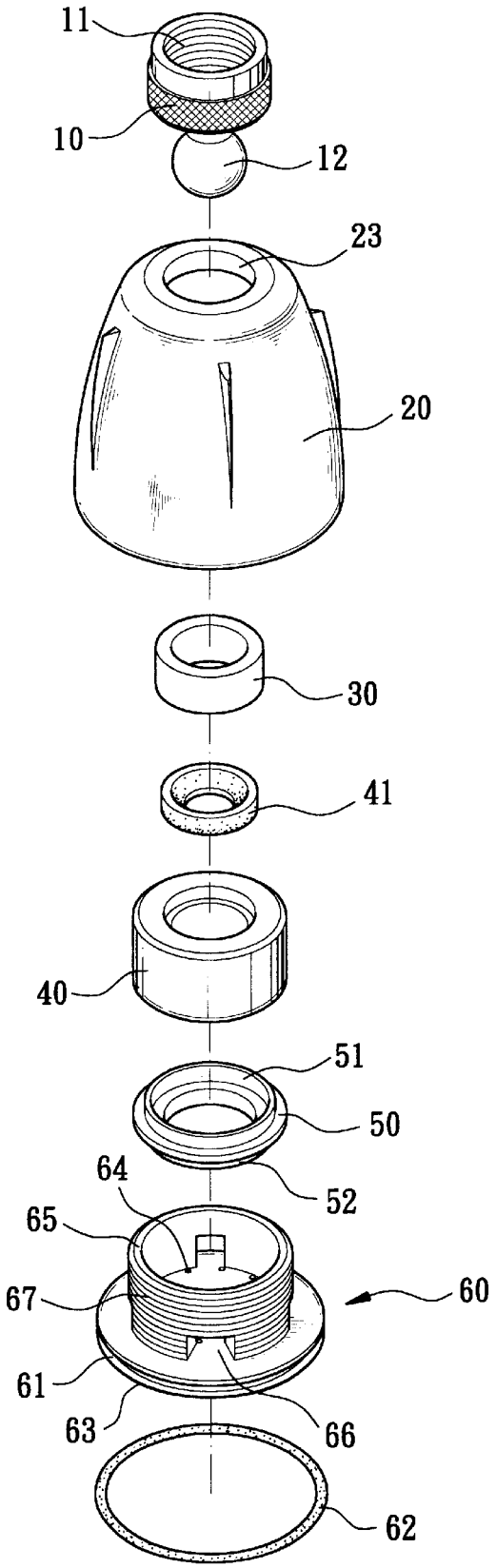
FIG. 4 is an exploded perspective view of the single-functional shower head assembly as shown in FIG. 3.

Referring to FIGS. 3 and 4, a single-functional shower head assembly in accordance with the present invention primarily comprises a hollow universal connector 10, a shower head housing 20, a fit ring 30, a substantially cylindrical urging member 40, a buffer pad 50, and a water outlet panel 60.

The hollow universal connector 10 has a first end formed with a water inlet 11 and a second end formed with a ball 12.

The shower head housing 20 has a first end formed with a water outlet 21 and a second end formed with a first seat 22 defining a hole 23. A second seat 24 is formed in the shower head housing 20 and located beside the first seat 22. The hole 23 of the first seat 22 of the shower head housing 20 has a diameter slightly greater than that of the ball 12 of the universal connector 10 for allowing passage the ball 12 of the universal connector 10.

The fit ring 30 having a slight elasticity is fitted on the ball 12 of the universal connector 10 in a forcibly fit manner. The fit ring 30 is expanded by pressing of the ball 12 of the universal connector 10 to be inserted into the first seat 22 of the shower head housing 20. The fit ring 30 has a tapered inner wall 32 urged on the ball 12 of the universal connector 10. The diameter at the inlet of the tapered inner wall 32 of the fit ring 30 is slightly smaller than that of the ball 12 of the universal connector 10. The fit ring 30 has an outer wall having a diameter slightly greater than that of the first seat 22 of the shower head housing 20.

The substantially cylindrical urging member 40 is mounted in the second seat 24 of the shower head housing 20 and has an end face recessed with a ring 42. The single-functional shower head assembly further comprises a sealing gasket 41 mounted between the ball 12 of the universal connector 10 and the urging member 40.

The buffer pad 50 is mounted in the second seat 24 of the shower head housing 20 and has a fist end formed with a first flange 51 fitted into the ring 42 of the urging member 40 and a second end formed with a second flange 52.

The water outlet panel 60 is secured on the first end of the shower head housing 20 and includes a circular plate 61 secured in the water outlet 21, and an annular wall 65 mounted on the circular plate 61 and rested on the second flange 52 of the buffer pad 50. The circular plate 61 of the water outlet panel 60 has a water outlet face 63 defining a plurality of water outlet holes 64 located in the annular wall 65. The annular wall 65 of the water outlet panel 60 defines a plurality of openings 66.

The single-functional shower head assembly further comprises a sealing ring 62 mounted between the circular plate 61 of the water outlet panel 60 and the water outlet 21 of the shower head housing 20.

The second seat 24 of the shower head housing 20 has an inner wall formed with an inner thread 25, and the annular wall 65 of the water outlet panel 60 is formed with an outer thread 67 screwed into the inner thread 25 of the second seat 24 of the shower head housing 20, so that the annular wall 65 of the water outlet panel 60 is secured in the second seat 24 of the shower head housing 20.

In assembly, when the annular wall 65 of the water outlet panel 60 is screwed the inner thread 25 of the second seat 24 of the shower head housing 20 into a secure position, the urging member 40 forces the sealing gasket 41 to urge the ball 12 of the universal connector 10, thereby achieving the effect of stopping passage of water, and thereby positioning the universal connector 10.

Accordingly, the shower head assembly in accordance with the present invention has the following advantages.

1. The universal connector has a smaller volume and a lighter weight, thereby decreasing cost of material and fabrication.

2. The defective products during production are greatly reduced, thereby enhancing the quality of products and increasing the productivity.

3. The sealing ring is not subjected to an external force, thereby increasing the lifetime thereof. In addition, maintenance and replacement are easy and simple when the sealing ring is worn out, without having to replace a new shower head.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A single-functional shower head assembly, comprising:

a hollow universal connector (10) having a first end formed with a water inlet (11) and a second end formed with a ball (12);

a shower head housing (20) having a first end formed with a water outlet (21) and a second end formed with a first seat (22) defining a hole (23), a second seat (24) formed in said shower head housing (20) and located beside said first seat (22);

a fit ring (30) having a slight elasticity fitted on said ball (12) of said universal connector (10) in a forcibly fit manner, said fit ring (30) being inserted into said first seat (22) of said shower head housing (20) by pressing of said ball (12) of said universal connector (10);

a substantially cylindrical urging member (40) mounted in said second seat (24) of said shower head housing (20) and having an end face recessed with a ring (42);

a buffer pad (50) mounted in said second seat (24) of said shower head housing (20) and having a first end formed with a first flange (51) fitted into said ring (42) of said urging member (40) and a second end formed with a second flange (52); and a water outlet panel (60) secured on said first end of said shower head housing (20) and including a circular plate (61) secured in said water outlet (21), and an annular wall (65) mounted on said circular plate (61) and rested on said second flange (52) of said buffer pad (50).

2. The single-functional shower head assembly in accordance with claim 1, wherein said hole (23) of said first seat (22) of said shower head housing (20) has a diameter slightly greater than that of said ball (12) of said universal connector (10) for allowing passage said ball (12) of said universal connector (10).

3. The single-functional shower head assembly in accordance with claim 1, wherein said second seat (24) of said shower head housing (20) has an inner wall formed with an inner thread (25), and said annular wall (65) of said water outlet panel (60) is formed with an outer thread (67) screwed into said inner thread (25) of said second seat (24) of said shower head housing (20), so that said annular wall (65) of said water outlet panel (60) is secured in said second seat (24) of said shower head housing (20).

4. The single-functional shower head assembly in accordance with claim 1, wherein said fit ring (30) has a tapered inner wall (32) urged on said ball (12) of said universal connector (10).

5. The single-functional shower head assembly in accordance with claim 1, wherein said fit ring (30) has an outer wall having a diameter slightly greater than that of said first seat (22) of said shower head housing (20).

6. The single-functional shower head assembly in accordance with claim 1, further comprising a sealing gasket (41) mounted between said ball (12) of said universal connector (10) and said urging member (40).

7. The single-functional shower head assembly in accordance with claim 1, further comprising a sealing ring (62) mounted between said circular plate (61) of said water outlet panel (60) and said water outlet (21) of said shower head housing (20).

8. The single-functional shower head assembly in accordance with claim 1, wherein said circular plate (61) of said water outlet panel (60) defines a plurality of water outlet holes (64) located in said annular wall (65).

9. The single-functional shower head assembly in accordance with claim 1, wherein said annular wall (65) of said water outlet panel (60) defines a plurality of openings (66).

* * * * *